US005875719A

United States Patent [19]

Francis

[11] Patent Number: 5,875,719

[45] Date of Patent: Mar. 2, 1999

[54] BAGGAGE TAG WITH PRINT HEAD CLEANING POUCH

[75] Inventor: Dennis F. Francis, Plano, Tex.

[73] Assignee: Data Documents, Omaha, Nebr.

[21] Appl. No.: 598,013

[22] Filed: Feb. 7, 1996

[51] Int. Cl.[6] ..... B41F 35/00

[52] U.S. Cl. ..... 101/424; 400/702

[58] Field of Search ..... 101/424, 483, 101/423; 400/701, 702

[56] References Cited

U.S. PATENT DOCUMENTS

| | | | |
|---|---|---|---|
| 1,637,153 | 7/1927 | Lawton . | |
| 1,960,192 | 5/1934 | Howard | 15/209 |
| 2,394,855 | 2/1946 | Gould | 197/184 |
| 2,796,367 | 6/1957 | Brown | 134/6 |
| 2,800,215 | 7/1957 | Converse | 197/185 |
| 3,367,785 | 2/1968 | Finucane et al. | 99/171 |
| 3,472,675 | 10/1969 | Gordon et al. | 117/36.9 |
| 3,477,083 | 11/1969 | Park | 15/104 |
| 4,611,361 | 9/1986 | Shinkai | 15/104.93 |
| 4,891,265 | 1/1990 | Samagalsky | 428/280 |
| 4,933,015 | 6/1990 | White | 134/6 |
| 5,081,472 | 1/1992 | Fisher | 346/140 |
| 5,536,328 | 7/1996 | Morgavi | 101/423 |
| 5,563,646 | 10/1996 | Fukuda | 400/702 |
| 5,688,060 | 11/1997 | Terao | 400/701 |

*Primary Examiner*—John Hilten
*Assistant Examiner*—Anthony H. Nguyen
*Attorney, Agent, or Firm*—Zarley, McKee, Thomte, Voorhees & Sease; Dennis L. Thomte

[57] ABSTRACT

The present invention provides an apparatus and method for cleaning the print head of a baggage tag printer used for printing passenger identification and destination indicia thereon. The print head cleaner comprises a plurality of baggage tags secured to one another in end-to-end relation forming an elongated strip of baggage tags. The cleaner is secured to the last of the tags for automatic advancement into the printer upon completion of the printing of the final tag. The cleaner includes a quantity of print head cleaning fluid enclosed in a pouch which bursts upon passage through the printer. A paper tail may be fastened to the pouch for frictional engagement with the print head facilitating the cleaning thereof.

17 Claims, 4 Drawing Sheets

BAGGAGE TAG WITH PRINT HEAD CLEANING POUCH

BACKGROUND OF THE INVENTION

1. Technical Field

The apparatus of the present invention relates generally to baggage identification tags. More specifically, it relates to a novel cleaning pouch the use of which, in conjunction with baggage tags, is completely transparent to the user.

As is well understood by travelers, each piece of luggage is individually tagged with the traveler's coded identification and destination. The blank tags and printers for printing such identification information thereon, have been around for some time. As is well understood in the art, these baggage tags are pre-packaged in large numbers for use by the ticket agents. The tags are fastened together in end-to-end relation and placed in a fan-fold configuration for removal from the box. Generally, when a new box of tags is opened, the first of the tags is inserted into the machine manually. The printer then automatically feeds in a new tag as each is printed. The printed tag then emerges out the opposite side of the machine.

A perforation is provided at each tag-tag junction to facilitate separation. Additionally, a translucent window is provided for automatic detection of this junction. Thus, the advancement of tags through the printer may be controlled using this "end-of-tag" signal both as a stop signal and for accounting and tracking purposes as a means for indicating that another tag has been printed.

The cleaning pouch of the present invention is adapted to be secured to the final tag of this series of baggage tags. This securement would preferably be accomplished during packaging of the tags. Thus, the cleaner is formed as park of the package, requiring no action on the part of the ticket agent. As mentioned, when the final tag in the series is printed, the cleaning pouch would be automatically advanced into the printer as part of the tag series. The cleaner pouch, containing a quantity of cleaning fluid, is constructed of material which may be burst when compressed upon passage through the printer. Additionally, as part of the preferred design, the cleaner may also comprise a paper tail secured to the pouch. Upon bursting of the cleaner pouch, the cleaning fluid wold be discharged onto the paper tail. Upon further advancement of the tag through the machine, the paper tail will be frictional engaged by the print head further facilitating this cleaning.

2. Description of the Prior Art

Baggage identification tags and the associated printers have been used for some time. One example of such a tag is the three ply tag manufactured by Data Documents.

As mentioned, the tag is comprised of three plys. The top ply is composed of paper and comprises the surface on which the identification information is printed. Below the paper ply is an adhesive layer, used to permanently join the paper ply to the second ply. This second ply is comprised of tear resistant VALERON, used to impart a degree of tear resistance to the tag. Another layer of adhesive is used to disengagably attach the VALERON ply to the paper liner which comprises the final ply.

As mentioned, the tags are interconnected end-to-end, having a perforation at the junction of each tag to aid in the separation. Additionally, a translucent window is provided at each junction in order to facilitate the automatic detection of the junction by the printer. The printer includes a sensor operative to detect this window and thus identify the printing of a new tag. This window also is used for flow control as it stops the advancement of tags through the machine until another is printed. The perforation then allows the agent to remove the printed ticket by tearing it from the next ticket.

The print head used to print these identification tags is conventional in nature. As will be understood by those in the art, after a quantity of tags have been printed, the print head will become dirty from the printing dye etc. as well as from various fibers from the tags. Consequently, it is necessary for the heads to be cleaned periodically to ensure proper operation.

In the past, this cleaning has been accomplished in one of two ways. First, the ticket agent or maintenance person may open up the printer housing and apply cleaner to the print head. Another method is for the ticket agent or maintenance person to manually insert a cleaning tag into the machine to facilitate the cleaning of the print head. While both of these methods are effective, they are very time consuming. Additionally, they require the recognition by the ticket agent or maintenance person that a cleaning is required. Clearly, this type of maintenance function is one of the lower priorities of the agent and as such is susceptible to being forgotten. If too much time elapses between cleanings, a fouled print head can result in garbled tags and lost baggage.

Consequently, it is a primary objective of the present invention to provide a baggage tag printer cleaning mechanism adapted for automatic use capable of providing a periodic cleaning of the print heads without the need for the ticket agent or maintenance person remembering such a cleaning.

An additional objective is to provide a baggage tag printer cleaner adapted for use with conventional baggage tags.

Another objective is to provide a baggage tag printer wherein the cleaner is adapted to be secured to the final tag in a pre-packaged series of tags such that the cleaner is drawn into the machine as part of the normal printing process.

Another objective of the present invention is to provide a baggage tag printer cleaner wherein the cleaner apparatus is secured to the final tag in such a manner that the an opaque junction is formed thereby preventing the printer end-of-tag detector from sensing the beginning of a new tag as the cleaner apparatus is drawn into the printer.

Another objective of the present invention is to provide a baggage tag printer cleaner comprising a pouch, containing a quantity of cleaning fluid, secured to the final tag and a paper tail attached to the pouch such that upon advancement of the pouch through the printer and the release of the cleaning fluid therein, the paper tail and the cleaning fluid disposed thereon, frictionally engages the print head, cleaning debris such as ink and adhesive, therefrom.

Another objective is to provide a baggage tag printer cleaner comprises a pouch containing a quantity of cleaning fluid and wherein the pouch is constructed such that upon passage of the pouch through the printer, the cleaning fluid is released out the rear of the pouch and onto the paper tail.

Another objective is to provide a baggage tag printer cleaner wherein the cleaning fluid is alcohol.

SUMMARY OF THE INVENTION

The present invention provides a cleaning apparatus for cleaning the print head of a baggage tag printer used for printing passenger identification and destination indicia thereon. The print head cleaner comprises a plurality of baggage tags secured to one another in end-to-end relation forming an elongated strip of baggage tags. The tags are adapted for sequential feeding or advancement through the printer. The plurality of baggage tags including a translucent portion between each tag providing a means for automatic detection of the end of that respective baggage tag. The cleaner includes a quantity of print head cleaning fluid enclosed in a burstable packet or pouch. In one embodiment, the cleaning fluid comprises alcohol.

The pouch is fastened to one of the baggage tags. The means for fastening the pouch to the tag would be selected so as to provide an opaque connection between the burstable pouch and the tag. Thus, the fastening means permits advancement of the tag through a printer without signalling the end of the baggage tag to which the packet is connected. Additionally, a paper tail may be fastened to the side of the pouch opposite the baggage tag. This paper tail facilitates the cleaning of the print head through further frictional engagement therewith.

Advancement of the tag and connected cleaner through the printer brings the fluid containing pouch into contact with the internal printer mechanisms. Upon pressure contact between the printer mechanism and the burstable pouch, the pouch would be compressed to the point that it bursts. The pouch is designed an constructed with its rear wall, as the weakest part of the pouch. Therefore, bursting of the occurs at the rear wall. Consequently, the cleaning fluid will be sprayed onto the paper tail which is secured rearwardly of the pouch.

The invention also describes a method of cleaning the print head of a baggage tag printer. The steps would include providing a baggage tag on which passenger identification and destination information is to be printed and a printer for printing identification information on the tag while advancing the tag through the printer. A cleaner tag is provided having a quantity of cleaning fluid contained within a burstable pouch. The passenger and destination identification information is printed on the tag as the tag is advanced through the machine. As the tag is advanced through the machine, the burstable pouch is brought into contact with the internal printer components including the print head, bursting the container and releasing the cleaning fluid. The cleaner may also have a paper tail attached to the pouch in which case bursting the pouch releases the cleaner onto the paper tail and wherein further advancing the cleaner through the printer brings the paper tail into frictional contact with the print head facilitating the cleaning thereof.

DESCRIPTION OF THE PREFERRED EMBODIMENT

The baggage tag printer print head cleaner of the present invention is adapted for use with a series of pre-packaged baggage tags. The cleaner is adapted to be fastened to the final tag such that upon printing of the last tag, the cleaner is automatically advanced into the printer and into contact with the printing mechanism. Upon contact with the printer mechanism, the cleaner pouch containing cleaning fluid ruptures spewing the cleaning fluid onto a paper tail. As the cleaner is further advanced through the printer, this paper tail contacts, frictionally engages, and cleans the print head 92.

Figure 1:
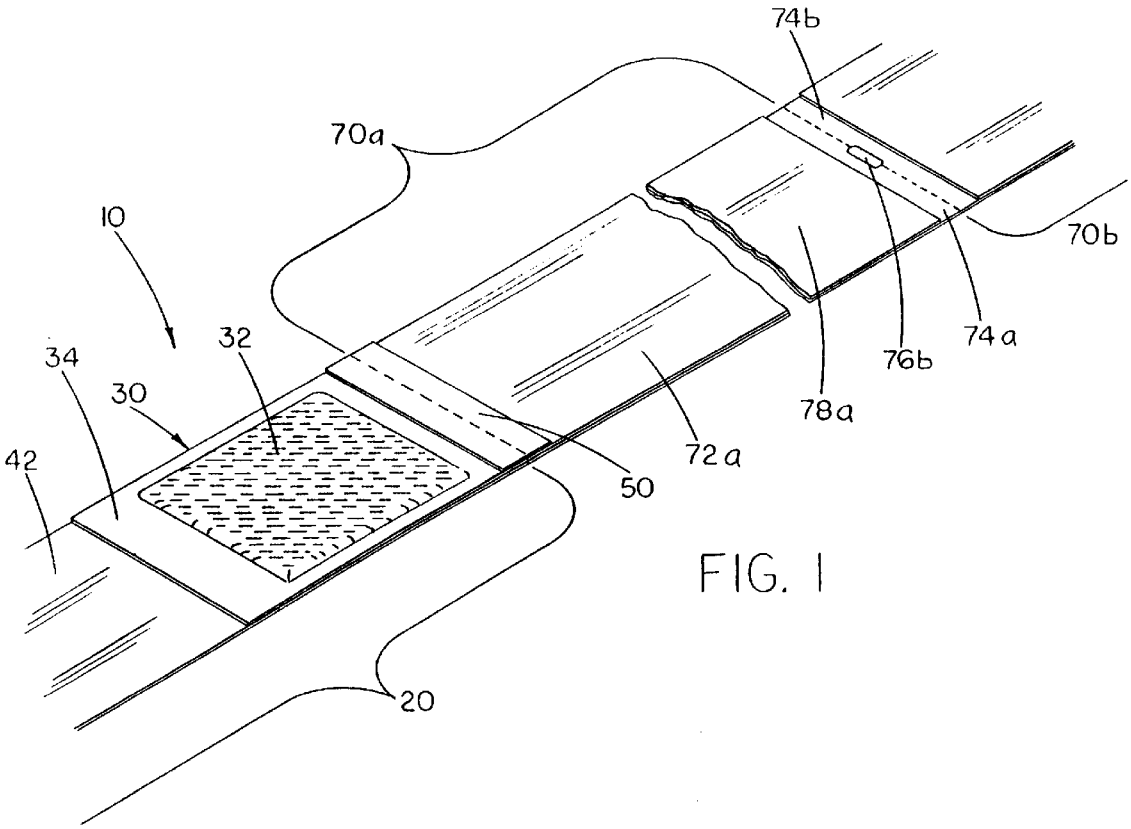
FIG. 1 is a top perspective view of the baggage tag printer cleaner of the present invention showing the major components thereof and how the cleaner is secured to the final tag.

A preferred embodiment of the present invention is illustrated in the perspective view of FIG. 1. This view, illustrates the main components of the baggage tag cleaner 10 of the present invention and its attachment to the final tag 70*a* in a series of pre-packaged tags.

In the figures, the reference numerals 70*a*, 70*b*, and 70*c* are used to refer to the last, second from last, and third from last, baggage tags respectively. Similarly, the reference numeral 7*xa*, 7*xb*, and 7*xc* are used to refer to similar features in the respective tags.

As will be understood in the art, the conventional baggage tags such as 70*a* generally comprise an elongated paper portion 72*a* and a smaller paper portion 78*a*. The longer portion 72*a* comprises the portion of the tag which would be placed around the luggage handle. The smaller portion 78*a* represents the claim stub portion which would be placed in the passenger's ticket jacket or otherwise retained by the passenger. Underlying the two paper portions is a liner 74*a*. Liner 74*a* is used to protect the underside of the paper portions, which are generally covered with some type of adhesive in order to facilitate placement of the tag around the baggage handle. The liner 74*a* is generally constructed of VALERON or similar material which resists tearing. Additionally, the liner 74*a* provide the means for joining the tags together.

Figures 3, 9:
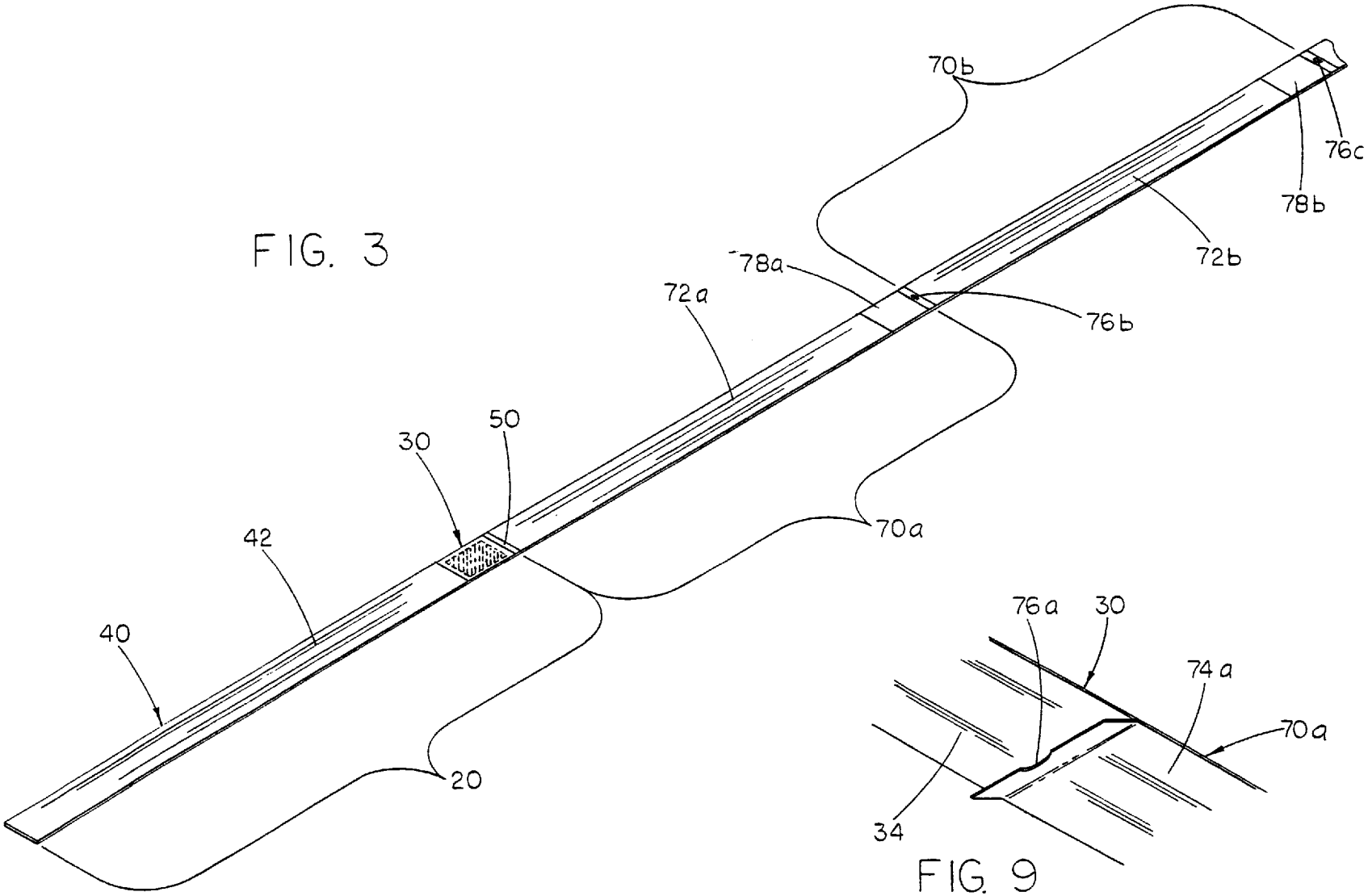
FIG. 3 is a top perspective view showing the entire cleaning apparatus and the final two tags in a series of prepackaged tags illustrating how the cleaner is attached thereto.
FIG. 9 is a bottom perspective view of the illustrating the attachment of the cleaner pouch to the last of the pre-packaged baggage tags.

As mentioned, the tags are manufactured such that they are arraigned end-to-end fashion. FIG. 3 illustrates the final two of such a series of tags. FIG. 1 is a top perspective view showing in cut-away, the final tag 70*a* and its attachment to the preceding tag 70*b*. It will be noticed from the figures that the liners, e.g. 74*a* and 74*b* etc., provide the attachment point for consecutive tags. A perforation is provided in the two liners facilitating separation of the tags once printing is complete. Careful observation of the figures also revels the existence of a tiny widow, e.g. 76*b*, at the perforated junction of the VALERON layers, 74*a* and 74*b* of the two tags, 70*a* and 70*b* respectively. This window serves an important function in the automatic printing and advancement of tags through the printer discussed in more detail below.

Figure 4:
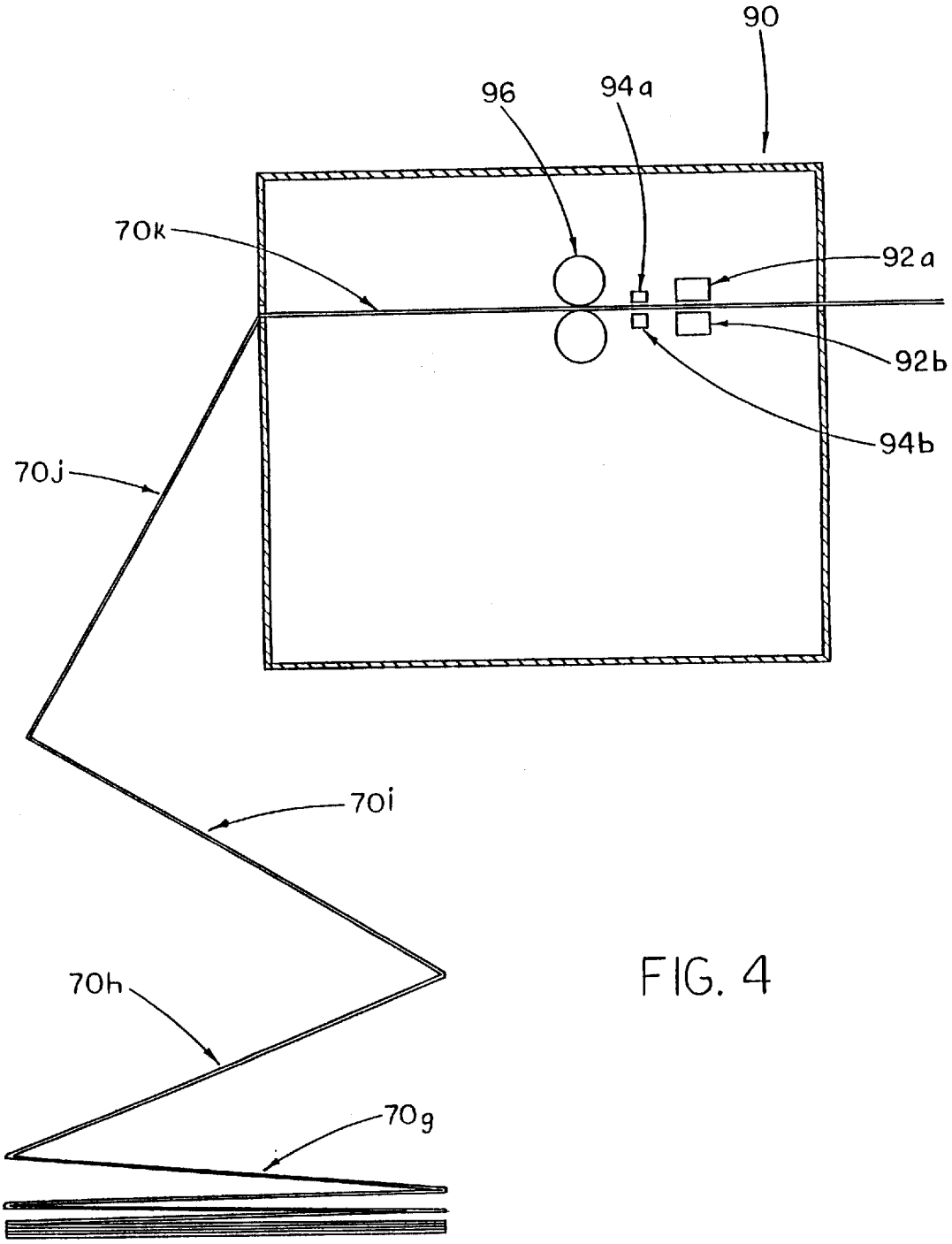
FIG. 4 is a cross-sectional side view showing the working environment of the cleaner of the present invention, particularly, how tickets are fed into the tag printer.
Figure 5:
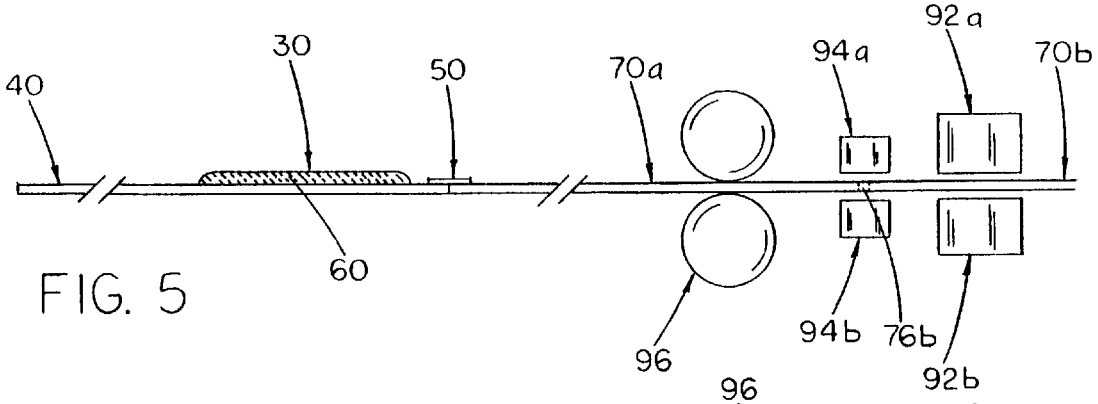
FIGS. 5–8 are enlarged sectional side views illustrating the advancement of the final baggage tag and connected cleaner pouch through the printer, the compression of the pouch, and release of the cleaner therein onto the paper tail.

FIG. 4 illustrates a typical printer 90 for printing of baggage tags. The figure shows only the major components of the printer 90 relevant to the present invention. Many different printers may be used for printing baggage tags and the present invention is not limited to any one printer design. One example of such a baggage tag printer is the Atech 201.

As mentioned above, the printer 90 includes a means for determining the junction between to sequential tags by sensing the transmission of light through this window. The sensing of an "end-of-tag" has important procedural consequences in the tag printing process. For example, this signal causes the drive mechanism, including rollers 96, to stop, thereby halting the advancement of a tag through the printer 90. Even more importantly, this signal indicates that another tag has been printed and must be accounted for, presumably as a piece of luggage or as an erroneous printing.

The functioning of this "end-of-tag" detection system is important in the present context because it illustrates an important advantage of the present invention over the prior art. Namely, preventing the need to account for the cleaner as a printed tag.

As mentioned above, one prior art technique utilized to clean the print head 92 of a baggage tag printer was to manually feed a cleaner strip into the printer. However, since the strip was fed in after a tag had been printed, the feeding of the cleaner strip represented another tag to the machine. Consequently, the ticket agent was force to track this "tag" in the system as an invalid entry. Obviously, this necessitates some additional work on the part of the gate agent. Additionally, in the event the "tag" was not so identified, considerable time could be wasted trying to locate a non-existent piece of baggage.

The cleaning pouch 30 of the present invention solves this problem by the manner in which it is secured to the final tag 70*a* in the pre-packaged box. As discussed in more detail below, the pouch 30 is secured to the tag in such a fashion that an opaque junction is presented. Consequently, the end-of-tag detection system 94*a* and *b* of the printer 90 does not detect an end-of-tag at the junction between the final tag 70*a* and the cleaning pouch 30. Additionally, since the cleaning pouch 10 is secured to the end of the final tag 70*a*, it is advanced into the printer automatically as the final tag 70*a* in the series is printed. Thus, in addition to avoiding the tracking problem discussed above. The ticket agent is not required to periodically feed the cleaner into the machine. Rather this happens as a part of the normal printing process at the end of the string. Thus a more regular cleaning of the print head 92 is accomplished, keeping the print head 92 in better shape, resulting in better print quality and prolonged print head 92 longevity.

Figure 2:
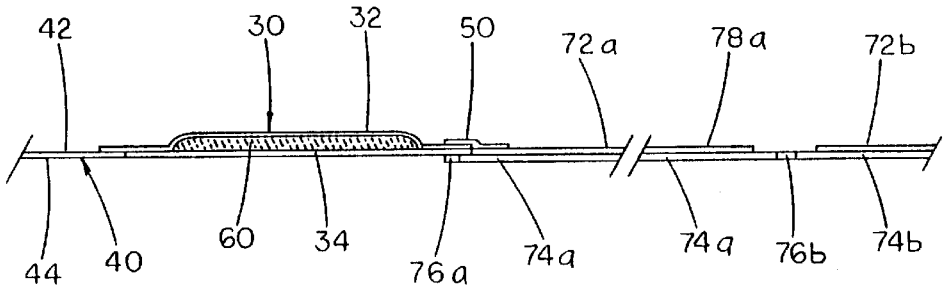
FIG. 2 is a cross-sectional side view of the baggage tag printer cleaner of the present invention showing in more detail the pouch containing the cleaning fluid and the plys comprising the cleaner and pouch components.

FIGS. 1, 2, and 9 illustrate top perspective, cross-sectional side, and bottom perspective views respectively of the cleaner 20 of the present invention and its attachment to the final baggage tag 70*a*. As seen in the figures, a principle component of a cleaner system is the pouch 30. Pouch 30 is a fluid-tight enclosure in which the cleaning fluid is maintained. In the preferred embodiment, pouch 30 comprises two plys 32 and 34 which are sealed in a fluid-tight manner around the periphery thereof and containing a quantity of cleaning fluid 60 therebetween. In the preferred embodiment, the cleaning fluid comprises alcohol.

As mentioned above, an important consideration in the construction and operation of the cleaner of the present invention is the manner in which it is connected to the final baggage tag 70*a*. It is important that such a connection be made in a manner that an opaque surface is presented so that the end-of-tag detector in the printer does not sense an end of tag at the tag/cleaner junction. In the present invention, this is accomplished using opaque tape 50. Additionally, the forward most portion of upper ply 32 overlaps the rear-most portion of tag paper layer 72*a* as seen in FIG. 2. Additionally, it is important to note that the translucent VALERON layer which would otherwise be exposed at the rear of tag 70*a* is covered by plys 32 and 34 of the cleaning fluid pouch 30.

FIG. 9 illustrates the rear-most portion of the VALERON layer 74*a* of the final baggage tag 70*a*. Normally, this portion of the VALERON would form one-half 76*a* of the detection window and serve as the junction point for the next tag in the series. However, in the case of the final tag 70*a*, this portion of the VALERON is covered as discussed, so as to preclude triggering of the end-of-tag indication. As a result of these construction techniques, the cleaner 10 of the present invention is adapted to be automatically advanced into contact with the print mechanism without triggering the indication of a new tag.

FIG. 3 is a top perspective view illustrating the attachment of the cleaner of the present invention to a series of baggage tags. As mentioned above, the tags are conventionally packaged in a series of tags attached in end-to-end fashion. FIG. 3 illustrates the final two tags 70*a* and 70*b* of the series. The cleaner 20 of the present invention is secured to the final 70*a* of these two tags by means of opaque tape strip 50. It will also be observed from the figure that the cleaner 20 comprises paper tail 40 which extends rearwardly of the pouch 30. As will be explained in more detail below, paper tail 40 facilitates the cleaning of the print head 92. Paper tail 40 would be connected to pouch 30 using some type of adhesive means. In the preferred embodiment, the rearmost portion of the top ply 32 of pouch 30 would be coated with an adhesive. This rearmost portion would extend rearwardly of the lower ply 34 as thus provide a surface against which the forward most portion of top surface 42 of paper tail 40 may be secured as illustrated in FIG. 3. Alternatively, tape or the like may be used in a fashion similar to that used at the junction of the tag 70*a* and the pouch 30. The means used to secure the paper tail 40 to pouch 30 is not important so long as no translucent space therebetween is provided. This criteria is so that the printer does not sense an "end-of-tag" at the junction of the pouch 30 and the paper tail 40. Additionally, since paper tail 40 is opaque, the end-of-tag indication will not occur until the paper tail 40 is advanced past the detector.

Figure 6:
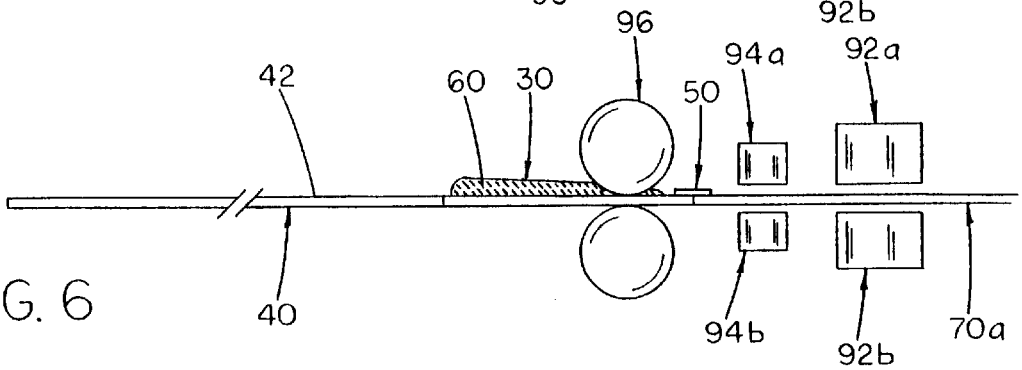

As mentioned, the paper tail 40 serves an important role in the cleaning of the print head 92. As seen in FIGS. 5–8 which illustrates a four step progression of the final tag 70*a* and the cleaner 20 as they are advanced through the printer 90. As seen in the first of the series, FIG. 5, window 76*b* is passing through the end-of-tag detector 94*a* and *b*. This corresponds with the positioning of the end of the next to last tag, 70*b*, under print head 92. Once the end-of-tag window 76*b* is sensed, advancement of the tags would be stopped. Upon the requirement for printing of another tag, the final tag 70*a* would be advanced into position. FIG. 6 illustrates the completion of the printing of final tag 70*a*. As seen in the figure, the end of the tag 70*a* is just about to come between detectors 94*a* and *b*. However, it will be noticed that no window will be placed between the detectors. Instead, tape 50 prevents the passage of any light therebetween. Consequently, the printer does not detect an end-of-tag at the junction between the final tag 70*a* and the cleaner. Therefore, as far as the printer and accounting system is concerned, cleaner 20 is simply considered part of the final tag 70*a*.

Figure 7:
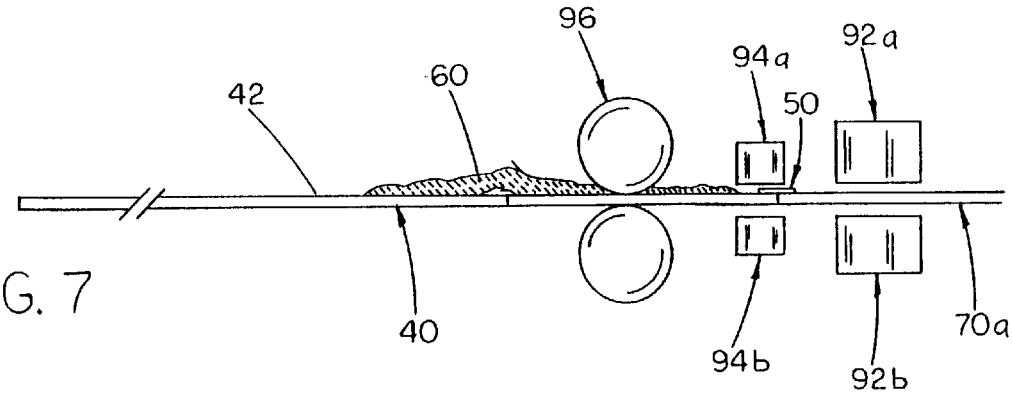
Figure 8:
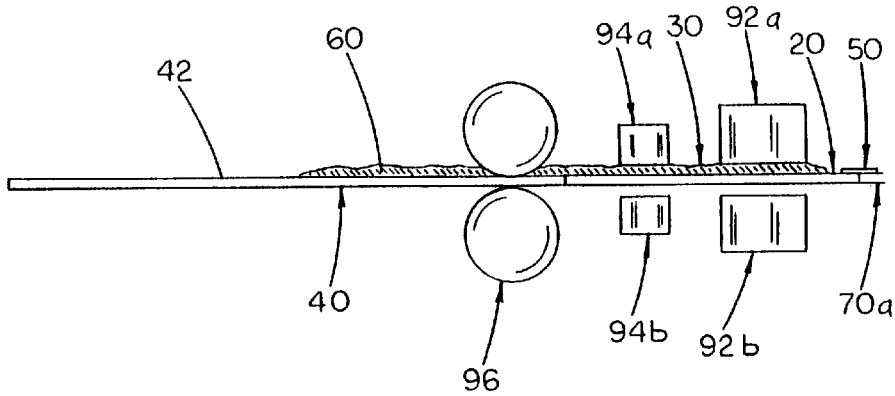

Also seen in FIG. 6, the rollers 96 are just beginning to engage the fluid pouch 30. Since the space provided between the two rollers 96 is approximately the same as the thickness of the tags, rollers 96 begin to flatten pouch 30 urging the fluid contained therein rearwardly. This rearward movement of the fluid continues until the pressure within the pouch 30 is so great that the pouch 30 bursts, spilling fluid 60. Pouch 30 is designed with its rear wall, adjacent the paper tail 40, as the weakest part of the pouch. Therefore, as seen in FIG. 7, the bursting of pouch 30 causes the fluid 60 to spill rearwardly, onto top surface 42 of paper tail 40, rearwardly of the rollers 96 as seen in FIGS. 7 and 8. As the cleaner 20 is further advanced, the paper tail 20 and the cleaning fluid 60 thereon, will be brought into contact with the print head 92. As is the case with rollers 96, the print head 92 is in substantial contact with the top surface 42 of paper tail 40. Thus, when the paper tail 40 is advanced through the printer 90, the paper tail 40 and cleaning fluid deposited thereon, will frictionally contact the surface of the head 92. This frictional contact, especially in conjunction with cleaning fluid 60, is operative to effect a cleaning of the head 92. Once the end of paper tail 40 is advanced through the printer 90, and more specifically past end-of-tag detector 94*a* and *b*, the printer will register final tag 70 as complete. A new box of tags would then be opened and started in the printer in the normal fashion.

It is apparent that numerous other modifications and variations of the present invention are possible in view of the above teachings. For example, numerous means may be used to connect the cleaning pouch and the final tag and to connected the paper tail, the important consideration being that an opaque junction be presented.

Therefore, it is to be understood that the above description is in no way intended to limit the scope of protection of the claims and it is representative of only one of several possible embodiments of the present invention.

There has thus been shown and described an invention which accomplishes at least all the stated objectives.

I claim:

1. A set of interconnected baggage tags adapted for cleaning a print head of a baggage tag printer through which said tags are passed for printing passenger identification and destination indicia thereon, said set comprising:

a plurality of baggage tags secured to one another in end-to-end relation to form an elongated strip of baggage tags adapted for sequential advancing through a printer, each of said plurality of baggage tags including a translucent portion adjacent one end for detection by the printer to signal the end of that respective baggage tag, a quantity of print head cleaning fluid, a burstable packet containing said quantity of cleaning fluid, and fastening means connecting said burstable packet to one of said baggage tags, said fastening means providing an opaque connection between said burstable packet and a baggage tag for passage through a printer without signalling the end of the baggage tag to which a packet is connected, said packet being burstable upon passage through the printer, thereby wetting said print head with cleaning fluid.

2. The set of baggage tags of claim 1 wherein said fastening means comprises a covering of said translucent portion adjacent said tag end.

3. The set of baggage tags of claim 1 further comprising an elongated tail connected to said burstable packet opposite said baggage tag such that, upon bursting of said packet, said cleaning fluid is sprayed onto said tail and further wherein said passing of said tags through a printer causes said tail to frictionally contact and clean said print head.

4. The set of baggage tags of claim 1 wherein said burstable packet is a sealed pouch.

5. The set of baggage tags of claim 3 wherein said elongated tail is a paper strip.

6. The set of baggage tags of claim 3 wherein said burstable packet comprises a weaker portion and wherein said weaker portion is positioned adjacent said elongated tail.

7. The set of baggage tags of claim 5 wherein said packet is connected to the last of the set of baggage tags and wherein said paper strip is the last portion of a set to pass through the printer.

8. In combination, a baggage tag printer having, means for advancing baggage tags therethrough and, a print head for printing passenger identification and destination information on the baggage tags, a plurality of baggage tags secured to one another in end-to-end relation to form an elongated strip of baggage tags adapted for sequential advancing through said printer, each of said plurality of baggage tags including a translucent portion adjacent one end for detection by the printer to signal the end of that respective baggage tag, a quantity of print head cleaning fluid, a burstable packet containing said quantity of cleaning fluid, and fastening means connecting said burstable packet to one of said baggage tags, said fastening means providing an opaque connection between said burstable packet and a baggage tag for passage through a printer without signalling the end of the baggage tag to which said packet is connected, said packet being burstable upon passage through said printer, thereby wetting said print head with cleaning fluid.

9. A print head cleaner for cleaning the print head of a baggage tag printer through which said tags are passed for printing indicia of the identification and destination of a passenger thereon, the print head cleaner adapted for use at the end of such a plurality of baggage tags connected in end-to-end relation, the cleaner comprising:

a quantity of cleaning fluid;

means for releasably containing said cleaning fluid; and means for securing said cleaning fluid containing means to the end of one of a plurality of baggage tags such that upon completion of printing on said tags, said cleaning fluid containing means is advanced into a printer and into contact with a printer print head, said containing means being burstable upon passage through the printer thereby wetting said print head with cleaning fluid.

10. The print head cleaner of claim 9 said plurality of tags are connected such that there exists a translucent space therebetween, said printer being operative to detect said translucent space thereby identifying one tag from another, said cleaning fluid containing means and said means for connecting said containing means being opaque such that upon advancement of said cleaner through said printer, said cleaner is not identified as a tag.

11. The print head cleaner of claim 9 wherein said plurality of serially connected baggage tags further comprise a perforation between said tags to facilitate the separation thereof and further wherein said perforation comprises an opening operative to further facilitate the identification of a preceding tag from a following tag.

12. The print head cleaner of claim 9 wherein said fluid containing means is a pouch.

13. The print head cleaner of claim 9 further comprising an elongated paper strip secured to said fluid containing means such that upon advancement of said cleaner through said printer, said paper strip is the last portion to pass through said printer, frictionally contacting and cleaning said print head as it is advanced through the printer.

14. The print head cleaner of claim 9 wherein said cleaning fluid comprises alcohol.

15. A method of cleaning the print head of a baggage tag printer comprising the steps of:

providing a baggage tag on which passenger identification and destination information is to be printed;

providing a printer for printing identification information on said tag while advancing said tag through said printer;

providing a print head cleaner having, a quantity of cleaning fluid;

means for releasably containing said cleaning fluid, said means being burstable upon passage through said printer; and means for securing said containing means to the end of said baggage tag such that upon completion of printing on said tag, said containing means is advanced into contact with said print head;

inserting said baggage tag into said printer;

printing said passenger and destination identification information on said tag;

advancing said tag through said machine causing said cleaning fluid container means to burst upon passage through said printer, wetting said print head with said cleaning fluid for cleaning it.

16. The method of claim 15 wherein the step of providing a baggage tag comprises:

providing a plurality of tags detachably secured one to another in an end-to-end fashion by a translucent fastening means, said translucent fastening means permitting the identification of one ticket from the other;

and further wherein the step of providing a printer comprises providing a printer adapted to detect said translucent fastening means;

and further wherein the step of providing said cleaning fluid containing means of said print head cleaner comprises providing a plastic pouch and wherein said means for securing said pouch to said tag is opaque such that advancement of said cleaner pouch through said printer does not register said pouch as another baggage tag;

and further wherein the step of advancing the tag through the printer comprises;

inserting the first of said plurality of tags into said printer and printing said identification and destination thereon; and sequentially advancing said tag through said machine and printing one tag after another until said plurality of tags is exhausted whereupon said cleaning fluid pouch contacts said print head bursting said pouch, wetting said print head with cleaning fluid.

17. The method of claim 16 wherein the step of providing a print head cleaner includes providing an elongated paper strip secured to said cleaning fluid container pouch such that upon advancement through said printer, said pouch bursting, wetting said paper strip with cleaning fluid and wherein said wetted paper strip is the final portion to pass through said printer, frictionally contacting and cleaning said print head.

* * * * *